United States Patent [19]

Hollingsworth

[11] Patent Number: 4,822,482

[45] Date of Patent: Apr. 18, 1989

[54] HYDRAULIC SEPARATING APPARATUS AND METHOD

[75] Inventor: Clinton A. Hollingsworth, Lakeland, Fla.

[73] Assignee: C-H Development and Sales, Inc., Lakeland, Fla.

[21] Appl. No.: 48,363

[22] Filed: Apr. 11, 1987

Related U.S. Application Data

[63] Continuation-in-part of Ser. No. 820,675, Jan. 21, 1986, abandoned.

[51] Int. Cl.[4] ..... B03B 5/62

[52] U.S. Cl. ..... 209/158; 209/211; 209/454

[58] Field of Search ..... 209/17, 158–161, 209/211, 454, 456

[56] References Cited

U.S. PATENT DOCUMENTS

| | | | |
|---|---|---|---|
| 1,449,603 | 3/1923 | Hokanson | 209/159 |
| 1,705,351 | 3/1929 | Andrews | 209/454 |
| 2,105,101 | 1/1938 | Stelley | 209/158 |
| 2,629,496 | 2/1953 | Laughlin | 209/454 |
| 2,857,050 | 10/1958 | Nebel | 209/159 |
| 2,859,872 | 11/1958 | Hirst | 209/158 |
| 2,967,617 | 1/1961 | Evans et al. | 209/211 |
| 3,075,643 | 1/1963 | Delachanal | 209/158 |
| 3,308,951 | 3/1967 | Evans | 209/158 |
| 3,643,129 | 2/1972 | McDaniel | 209/159 |
| 4,272,251 | 6/1981 | Beckberger et al. | 209/158 |
| 4,539,103 | 9/1985 | Hollingsworth | 209/211 |

*Primary Examiner*—Robert B. Reeves
*Assistant Examiner*—Donald T. Hajec
*Attorney, Agent, or Firm*—Flehr, Hohbach, Test, Albritton & Herbert

[57] ABSTRACT

The invention consists of an upright tank structure that includes axially aligned first and second tank parts, the first tank part being smaller in diameter than the second part. A first horizontal barrier plate having holes therethrough is mounted in the first tank part between upper and lower regions of the same. A second annular barrier having holes therethrough is mounted between the side walls of the first and second tank parts between upper and lower regions. Feed slurry is introduced into the upper region of the first tank part. Water under pressure is introduced into the region below both the first and second barriers and is caused to flow upwardly through the openings of the barriers with the formation of water jets extending upwardly from the openings. In operation the solids of the feed slurry are separated into coarse, fine and intermediate or middling fractions. The invention includes both apparatus and a method of operation.

11 Claims, 4 Drawing Sheets

HYDRAULIC SEPARATING APPARATUS AND METHOD

RELATED APPLICATIONS

This application is a continuation-in-part of application Ser. No. 820,675 filed Jan. 21, 1986 now abandoned.

This invention relates generally to hydraulic separating apparatus and methods for the separation of solids of different settling velocities from a feed slurry. It is applicable to effecting a separation that provides an overflow fraction containing solids of low settling velocities, an underflow fraction containing solids of relatively greater settling velocity, and a middling fraction containing solids having settling rates intermediate the settling rates of solids in the overflow and underflow fractions.

BACKGROUND OF THE INVENTION

Various apparatus and methods have been used to hydraulically separate slurries containing solids of different settling rates into several fractions. For example, U.S. Pat. No. 4,539,103, Sept. 3, 1985, granted to applicant, discloses a hydraulic separator suitable, for example, for the sizing of aqueous slurries containing solids differing in size and settling velocities, such as sand. The apparatus is characterized by a tank into which feed slurry is iintroduced tangentially to provide swirling of the material in the tank. The lower portion of the tank is provided with an annular barrier in the form of a perforated constriction plate and the upper end of the tank forms an overflow weir. Deflecting means in the form of a cone is mounted upon the constriction plate and serves to deflect solids moving downwardly toward the space immediately above the annular constriction plate. Means is also provided for introducing elutriation water into the space below the constriction plate. An underflow is removed from the region immediately above the constriction plate. Such apparatus functions efficiently for sizing and separating operations where overflow and underflow fractions are desired.

U.S. Pat. No. 3,308,951, Mar. 14, 1967, discloses apparatus which is stated to be capable of separating hydrous slurry into overflow, underflow and middling fractions. FIG. 2 of the patent discloses a tank structure made into aligned upper and lower parts, the lower part being provided with two constriction plates. Feed slurry is introduced into the upper tank part, and an overflow of fine product is removed from the upper part. The coarser solids progress downwardly through a cylindrical column to the lower part, where two fractions accumulate above the constriction plates, one consisting of coarse solids, and the other of solids of intermediate size. Siphoning pipes are used to remove the fractions accumulating above the constriction plates. Such apparatus and its method of operation, are subject to a number of operating disadvantages. The removal of solids by siphoning pipes tends to be critical with respect to control, particularly when the solids content of the feed slurry is subject to variations or the rate with which the slurry is introduced is subject to changes. Also siphoning pipes are subject to clogging.

U.S. Pat. No. 1,449,603 issued Mar. 27, 1923 discloses an apparatus and method for separating the particles of a slurry into three fractions having particles differing in settling velocities, but of the same particle size. Three concentric tank sections 5, 7 and 13 are employed to provide draw-off of particles differing in settling velocities. The heavier particles progress to the lower end of each section 7 and 13 and the lightest particles discharge as an overflow from the upper section 13. The feed slurry is first processed to reduce the solid particles to a common size and then introduced into the lower most tank section 5. From thence material progresses to the upper tank section 13 from which the particles of lowest specific gravity are removed in an overflow. Each tank section 7 and 13 at its lower end has an annular portion with holes 9 and 13 that receive separated particles of greatest specific gravity that are caused to settle in the main quiescent body of the corresponding chamber of the tank section. Water is introduced upwardly through these holes to maintain upward progression of lighter particles to the upper end of the tank section. The separating action takes place in the quiescent chambers A, B and E.

In general there is a demand for a high capacity apparatus and method capable of operating upon various feed slurries, which provides for the withdrawal of an intermediate or middling fraction, which is lacking in criticality and other operating difficulties.

OBJECTS OF THE INVENTION AND SUMMARY

In general it is an object of the invention to provide a separating apparatus and method which is relatively simple in construction and operation, and which provides for the removal of a middling fraction.

Another object is to provide such an apparatus and method which is lacking in criticality, particularly with respect to changes in the character and rate of feed slurry.

Another object is to provide an apparatus and method which makes possible the removal of a middling fraction in addition to the overflow and underflow fractions, and which makes use of what may be termed a velocity plate feature for carrying out the main separating operations.

Another object is to provide apparatus that is relatively compact for its capacity and is economical with respect to energy consumption.

In general, the apparatus of the invention consists of an upright tank structure which is circular in horizontal section. The structure includes vertically aligned first and second tank parts, the second part having a diameter substantially greater than the first part. The upper end of the first tank part is open to the interior of the second tank part at a level intermediate the upper and lower portions of the second tank part. The interiors of the two tank parts form first and second processing chambers. Means is provided for introducing aqueous feed slurry tangentially into the first chamber whereby material within the chamber swirls about the vertical axis. A first velocity barrier plate having holes therethrough is interposed between the upper and lower portions of the first chamber. A second annular velocity plate barrier having holes therethrough is disposed between the side walls of the first and second tank parts at a level below the upper end of the first tank part. Means are provided for introducing water into the spaces below each of the first and second barriers whereby water is caused to flow upwardly through the holes of both barriers. The upper open end of the first tank part forms a weir over which flow of slurry occurs between the two tank parts. Means is provided for removing a middling slurry fraction from the lower portion of the second tank part. Also means are provided for removing an underflow slurry of solids of greater settling velocity from the lower portion of the first tank part, and for removing an overflow fraction containing solids of low settling velocities from the upper end of the second tank part. The invention also includes the method of operation of the apparatus to provide a separated middling fraction in addition to overflow and underflow fractions.

Additional objects and features of the ivention will appear from the following description in which the preferred embodiments are set forth in detail in conjunction with the accompanying drawing.

DETAIL DESCRIPTION

Figure 1:
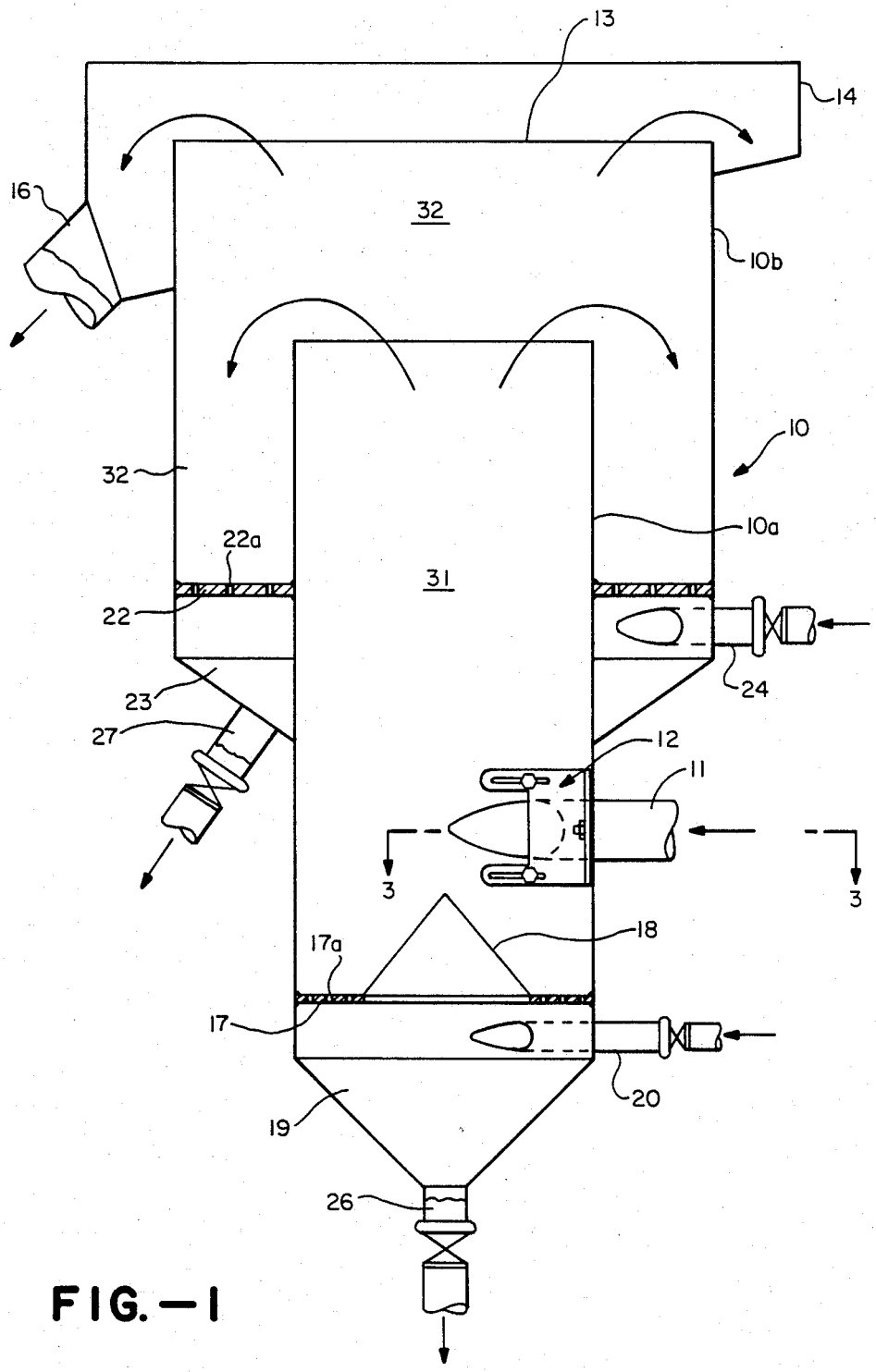
FIG. 1 is a side elevation in section schematically illustrating apparatus incorporating the present invention.

FIG. 1 of the drawing illustrates an upright tank structure 10 consisting of the two tank parts 10*a* and 10*b* that are disposed on a common vertical axis. The construction is such that in horizontal section, the two tank parts are circular. In the embodiment of the drawing both tank parts are cylindrical. Pipe 11 connects tangentially with the tank part 10*a* and serves to introduce feed slurry. A slide valve 12, which will be later described in detail, can be used to control the rate of introduction of feed slurry. The top of the tank part 10*b* forms an overflow weir 13, whereby the overflow fraction is collected in the launder 14, and discharged through the pipe 16.

The lower portion of the tank part 10*a* is provided with an annular barrier plate 17, which is of the velocity plate type as disclosed and claimed in my co-pending U.S. patent application Ser. No. 027,170 filed Mar. 17, 1987. The inner periphery of the annular barrier plate 17 serves to mount the deflecting cone 18. The space 19 below the annular barrier 17 is supplied with velocity water introduced through the pipe 20. It is preferable that this pipe connect with the space 19 tangentially. This serves to ensure good distribution of water to the holes 17*a* in the barrier 17.

The lower portion of the tank part 10*b* is likewise provided with an annular barrier plate 22 having holes 22*a* and which is of the velocity type. This barrier extends radially between the side walls of the tank parts 10*a* and 10*b*. The space 23 below the barrier 22 receives water by way of pipe 24. Here again it is preferable that pipe 24 connect tangentially with the space 23 to obtain good distribution. The upper end of the tank part 10*a* terminates intermediate the barrier 22 and the top of the tank part 10*b*, and is freely open to the interior of the tank part 10*b*. Thus material is free to flow over the upper edge of the tank part 10*a*. The lower end of tank part 10*a* is shown provided with a valve controlled pipe 26 through which underflow is removed. Likewise a valve controlled pipe 27 connects with the space 23 at the bottom of tank part 10*b*, and serves to remove a middling fraction.

Figure 4:
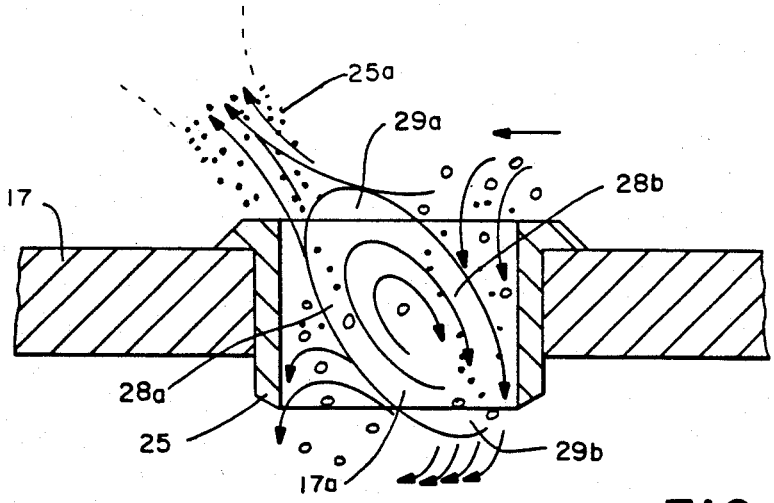
FIG. 4 is a detail in section schematically illustrating the separating action and eddy currents obtained by utilizing the velocity plate feature.

As indicated above, each of the barriers 17 and 22 make use of a so-called velocity feature in effecting separation between solids having different settling velocities. Referring to barrier 17, it consists of a plate (FIG. 4) provided with a series of holes 17*a* that are distributed circumferentially between the inner and outer perimeters of the plate, and which may be formed as shown in FIG. 4. In this instance each hole 17*a* is formed by a fitting 25, which is fixed within the barrier and which may be made of suitable molded plastic material. Water discharging from each such hole is schematically visualized in FIG. 4 as producing a jet-like stream 25*a* of water that extends upwardly from the barrier and is inclined by the swirling movement of material above the plate.

The barrier 22 is likewise of the velocity type, water introduced into the space 23 likewise jets upwardly through the holes 22*a* of the barrier 22, thus effecting a secondary separation whereby solid particles of intermediate settling rate are separated from solid particles of lower settling rate, and are withdrawn as a middling product through pipe 27. The particles of lower settling rate progress upwardly from the barrier 22 and are caused to overflow into the launder 14.

The space 31 in the tank part 10*a* above the barrier 17 may be referred to as a primary sizing or processing chamber. Likewise the space 32 above the barrier 22 and between the walls of the tank parts 10*a* and 10*b*, and also the space above the upper end of the tank part 10*a*, may be referred to as a secondary sizing or processing chamber 32. The term sizing is used when solid particles of the feed slurry vary in settling velocities due entirely or in part to differences in size. Thus, assuming use of such feed material, the underflow removed from space 19 through the pipe 26 consists of the relatively coarse granules of the slurry. The overflow being removed from the launder 14 consists of relatively fine solid particles. The middling product removed from space 23 through pipe 27 consists mainly of particles of intermediate size.

Figure 2:
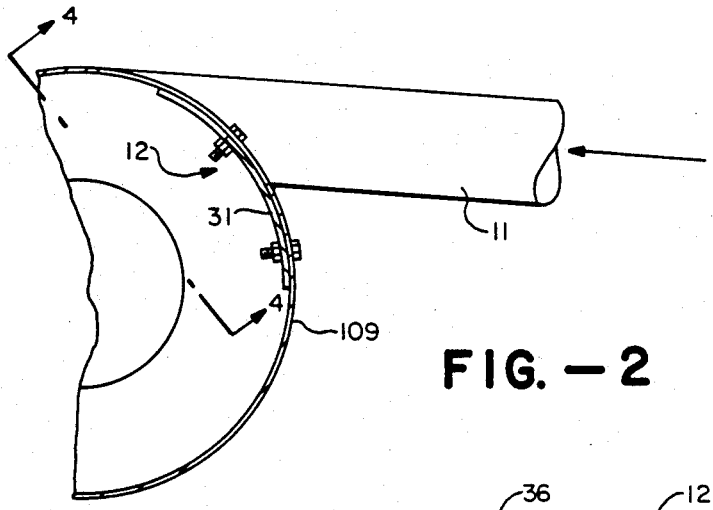
FIGS. 2 and 3 are details illustrating the construction of a slide valve for controlling the rate of introduction of slurry, FIG. 3 being taken on the section line 4—4 of FIG. 2.
Figure 3:
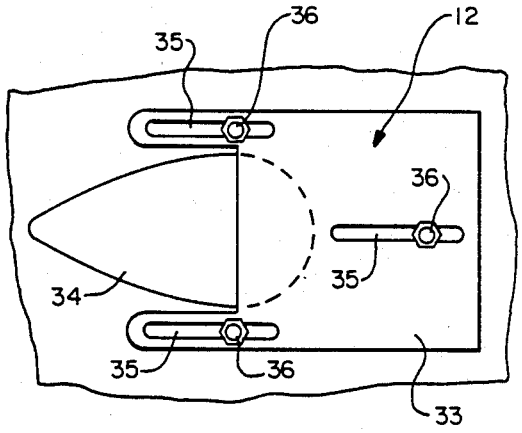

The slide valve 12 can be constructed as shown in FIGS. 2 and 3. It consists of a curved plate 33 which forms a flow control gate, and which is adjustably mounted on the inner surface of the side wall of the tank wall part 10*a*, whereby its position can be adjusted with respect to the opening 34 at the end of the pipe 11. Plate 33 has a plurality of slots 35 which accommodates the studs or bolts 36 that clamp the plate in a desired adjusted position. Feed slurry may be introduced by way of pipe 11 at a constant gravity head, in which event adjustment of plate 33 serves to adjust the rate of introduction into chamber 32. If the feed is pumped through pipe 12, adjustment of the plate 33 controls the velocity at which feed is introduced.

The apparatus and method described above have a number of advantageous features. Separation of the solids by use of the velocity feature provides an apparatus and method which is relatively stable and which accommodates changes in the feed slurry. Changes in solids content and changes in the rate of introduction of the slurry are readily accommodated and do not require frequent control adjustments. The feed slurry can be introduced under a relatively low gravity head, and the rate of introduction can be controlled for optimum operation by adjusting the slide valve 12. Products can be removed through the pipes 62 and 65 either continuously or intermittently, with continuous operation of the separating action. Swirling of material in the primrary sizing chamber 31 causes swirling movement of the slurry in the region adjacent the upper side of the barrier 17, and serves to carry particles into active contact with the jetting water thus insuring effective separating action. Swirling within the chamber 31 induces swirling movement in the secondary chamber 32 whereby movement of material in the region adjacent the upper side of barrier 22 likewise carries particles into the active separating action of the water jets.

The overall method of operation is as follows. It is assumed that the feed slurry contains solids varying in settling velocities, and which are to be processed to produce an overflow containing solids of low settling rate, an underflow containing solids of relatively fast settling rate, and a middling fraction containing solids of intermediate settling rate. The slurry as supplied to tank part 10*a* causes swirling movement in the primary chamber 31 and induces some swirling movement in the secondary chamber 32. Underflow solids progress downwardly through the water jetting through the holes 17*a* of barrier 17 and are removed from space 19. The remaining solids progress upwardly through chamber 31 and exit from the top of chamber 31 into the secondary chamber 32. Some of this material, including solids of intermediate settling rate, progress as shown by the arrows in FIG. 1 over the upper end of tank part 10*a* and then downwardly toward the barrier 22 where it is acted upon by the water jets to separate solids of the desired middling character from the solids of lower settling rate. The latter solids, together with solids of comparable character that progress upwardly from the primary chamber 31, progress upwardly and are discharged over weir 13 as an overflow.

Although the upward flow through each hole of the plate 17 may be less than the settling rate of the coarse, heavier particles, in practice the upward flow is substantially greater than the settling velocity of the heavier particles. This is attributed to the functioning of the velocity barrier plates which involves establishment and maintenance of eddy currents as schematically shown in FIG. 4. It has been found that with a feed slurry such as natural sand, effective use of eddy currents is obtained when each of the holes in the barrier are proportioned substantially as shown in FIG. 4 (e.g., $\frac{3}{4}$ inch diameter hole, $\frac{3}{4}$ inch in length), with the amount of water flowing through each hole from the space below the plate at a flow rate that is substantially greater than the settling rate of the underflow particles. This is deemed to be due to eddy currents produced in the individual holes of the barrier. Tests have been made using a laboratory model made of transparent plastic material which permits visual observation of solid particles moving through each hole of the barrier plate when operating under such conditions. An eddy current was observed within each hole and heavier particles were carried into the hole and delivered from the lower end of the hole. The form of the eddy currents, as viewed through the periphery of the circular barrier plate and looking toward the central axis of the tank, was such as to create a pronounced eddy in which water surged upwardly along one side of the hole from the lower to the upper side of the barrier plate and downwardly on the other side of the hole. This is schematically shown in FIG. 4. The upper ends of the side portions 28*a* and 28*b* of each eddy are shown connected by portions 29*a*, and the lower ends of the side portions are connected by portions 29*b*.

The flow path of the eddy appears to be oval, and is a continuous flowing stream which sweeps upwardly and downwardly past diametrically opposite side surfaces of the hole and across upper and lower ends of the hole. Particles in the region immediately above the barrier plate, which consist mainly of coarse or heavier particles with a minor portion of the fine material, are drawn into the eddy, progressed downwardly in the downwardly flowing eddy portion 28*b* and then discharged from the eddy into the space below the barrier. A minor portion of finer material is carried into the eddy and is returned to the upper side of the barrier plate by portion 28*a*. The swirling movement of slurry above the barrier, appears to supply energy to maintain the eddy action. Swirling movement of the water below the barrier plate is likewise deemed to contribute energy to maintain the eddy currents. Water sweeping across one or both ends of a hole due to the adjacent swirling action appears to react against side surfaces of the hole, thus contributing to maintenance of the eddy current. As indicated in FIG. 4, the eddy current is in an oval path about an axis that is radial to the vertical axis of the tank. The upward jet-like discharge from the plate is inclined due to the swirling action above the plate. Concurrent swirling action both below and above the plate is deemed preferable for optimum results.

To utilize the eddy effect to best advantage, certain dimensions and operating conditions are required. The ratio between hole diameter and length should be within certain limits, and the amount of water flowing through the holes from the space below the barrier should be such as to cause water to pass upwardly through the holes at a rate which is substantially greater than the settling velocity of the underflow solids. The swirling movent of the material in the upper tank section 10*a* provides some preliminary separation by gravity settling. It is believed that the static pressure within the eddy is sufficiently low to induce heavier particles from the jet to enter the eddy, and that the velocity of the eddying water is such that the heavier particles are carried through the hole and discharged into the space below the barrier plate. Assuming that the feed slurry is a natural sand, the ratio of hole diameter to hole length can be within the range of about 1 to 0.8, to 1 to 1.8 with holes having a diameter ranging from $\frac{1}{8}$ to $1\frac{3}{4}$ inches. The settling velocity of the underflow solids in a typical instance may be about 17 feet per minute, and the amount of water passing upwardly through each of the holes may be within a range of about 0.2 to 10 gallons per minute, which provides an upward flow rate of from 8 to 43 feet per minute. These figures may vary somewhat for optimum results, depending upon the varying "screen" analysis of the feed.

The functioning of eddy currents in conjunction with a velocity plate barrier is disclosed in my co-pending U.S. patent application Ser. No. 820,625 filed Jan. 21, 1987. In the present instant both velocity plate barriers, each utilizing eddy currents, cooperate to produce the three separate fractions, and the flow through the holes of each plate are adjusted for optimum operation. With respect to the lower plate 17 the upward flow through each hole is adjusted by the rate of introduction of water by way of pipe 20. With respect to the plate 22, the upward flow is adjusted by the rate water is introduced through pipe 24.

Good sharp separations are obtained with operation as described above. Some preliminary separation by gravity settling takes place in the upper tank part 10*a*. The heavier particles are acted upon by the jetting water above the barrier and then by the eddies that deliver the heavier particles into the space below the barrier. A minimum amount of finer particles that accompany the underflow particles into the holes are cycled back by the eddies into the space overlaying the barrier plate. The kinetic energy that maintains the eddies is deemed to be derived from the swirling action above and below the barrier plate. Some gravity settling separation commences in chamber 31 immediately following tangential introduction of the feed slurry and continues as the overflow fines progress upwardly and as underflow material progresses downwardly toward the barrier plate.

The same method of operation described above for plate 17 is employed in the functioning of plate 22. Here again the holes are so proportioned and the flow rate through each hole of plate 22 so controlled as to produce the eddy current and separating method described above for plate 17, as shown schematically in FIG. 4. When operating in this manner, relatively high capacity can be attained with compact equipment that is relatively insensitive to variations such as changes in the feed rate, in the solids content of the feed, or in the relative amounts of solids having different settling velocities. A feature of the invention is that it does not depend upon the maintenance of a teeter zone in each of the chambers 31 and 32 for effective separating action, although some gravity separation may take place in regions of the chambers 31 and 32 above the plates 17 and 22. The swirling action of the slurry and water in tank chambers 31 and 32 promotes effective separation by the jetting and eddy current action, because it causes continuous motion about the axis of the tank in the region above the barrier plate where the jetting action is effective. Swirling motion also aids in carrying particles of the slurry into the active regions of the jetting water and eddy currents.

Figure 5:
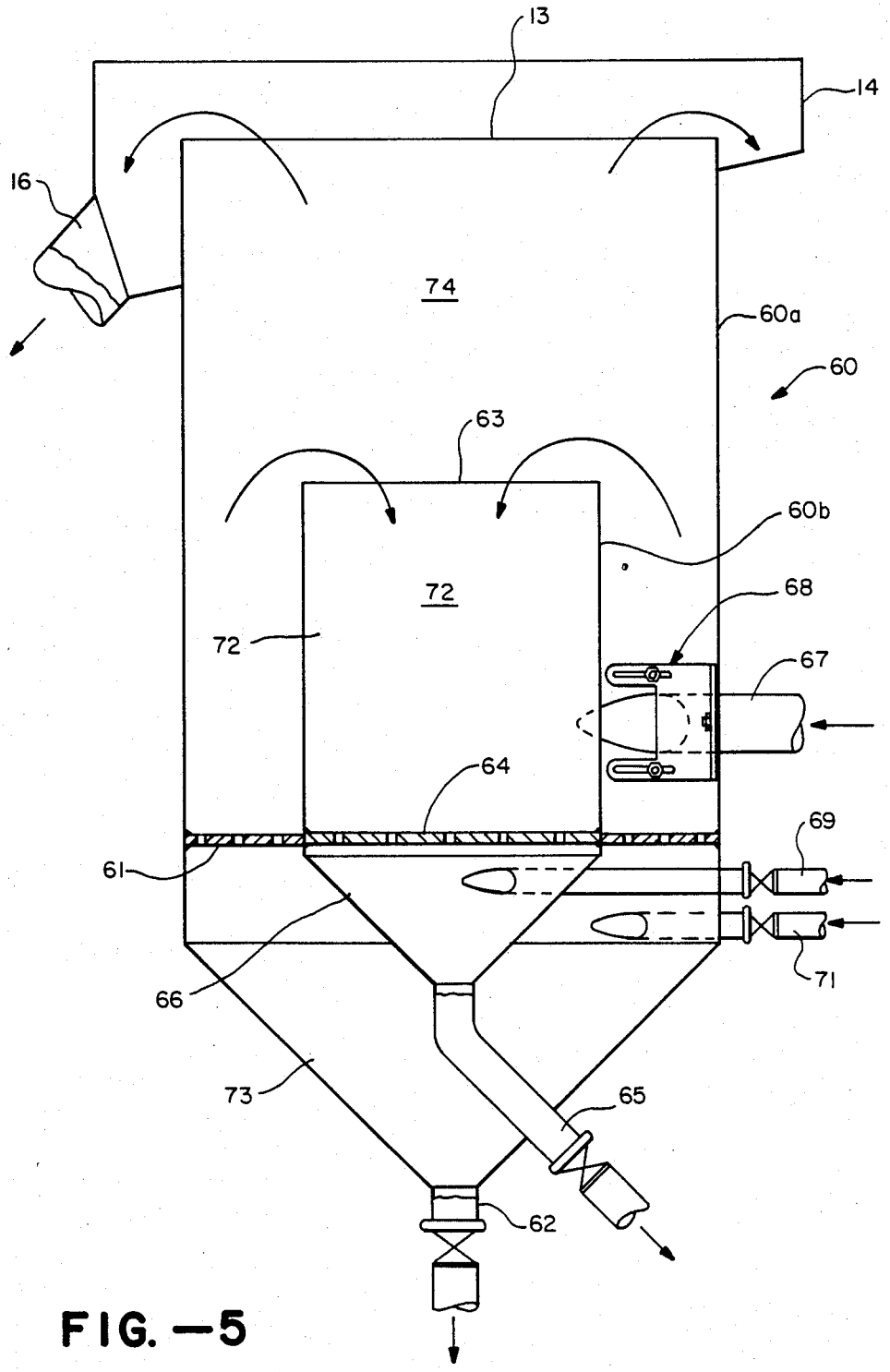
FIG. 5 is a side elevation in section schematically showing another embodiment of the invention.

The embodiment of FIG. 5 makes use of the velocity plate and eddy current features as in FIG. 1. However, the underflow is withdrawn from the lower end of the larger tank part and the middling fraction is withdrawn from the lower end of the smaller tank part. Thus the tank construction 60 consists of the tank parts 60*a* and 60*b*. The upper end of the tank part 60*a* is formed to provide the overflow weir 13, the launder 14 and overflow discharge pipe 16. The annular barrier 61 is of the velocity plate type and extends between the side walls of tank parts 60*a* and 60*b*. Valve controlled pipe 62 at the lower end of tank part 60*a* serves to remove underflow material. The smaller tank part 60*b* is disposed entirely within part 60*a* and is freely open at its upper end 63. It is shown secured to the inner perimeter of the annular barrier 61. It has a circular barrier 64 which likewise is of the velocity type. A valve controlled pipe 65 connects with the lower end 66 of tank part 60*b* and serves to remove a middling or intermediate fraction.

Feed slurry is introduced into the annular region between the two tank parts 60*a* and 60*b* by way of the tangential pipe 67. The rate of discharge of slurry can be controlled by the slide valve 68 which may be constructed as shown in FIGS. 3 and 4. Valve controlled pipes 69 and 71 which connect with the lower ends of tank parts 60*b* and 60*a*, preferably tangentially, serve to supply velocity water under pressure to the openings in the barriers 64 and 61. The holes in the barrier plate are proportioned and the upward rate of flow through each opening is adjusted for optimum operation with formation and maintenance of eddy currents.

The method of operation of the embodiment of FIG. 5 is as follows. Feed slurry is supplied to pipe 67 and the primary processing chamber 74 at a constant gravity head, whereby a swirling body of material is maintained. The pressure of water supplied to the space 73 below plate barrier 61 is controlled whereby the flow rate of water flowing upwardly through the holes and jetting upwardly from the barrier 61, establish and maintain eddy currents as previously described. The separated underflow fraction is removed through the pipe 62. The other fractions progress upwardly in chamber 74. Solids of intermediate settling velocities progress from chamber 74 into the upper portion of chamber 60*a* and into the secondary processing chamber 72. The pressure of water flowing into the space below barrier 64 by way of pipe 69 is controlled whereby the velocity of water flowing upwardly through the holes of the barrier and jetting upwardly from the barrier, is substantially greater than the settling velocity of the intermediate solids and are generally finer in size. Thus a secondary separation takes place whereby an intermediate or middling fraction is removed by way of pipe 65 and fine underflow solids are caused to progress upwardly to join the overflow material flowing over the weir 13.

In practice the apparatus and method can be controlled to produce separate fractions of the desired character from a particular feed slurry, and to adapt the method to slurries differing in their solid content and component settling velocities. For example, the rate of introduction of feed slurry may be controlled and also the rate of introduction of elutriation or velocity water.

Figure 6:
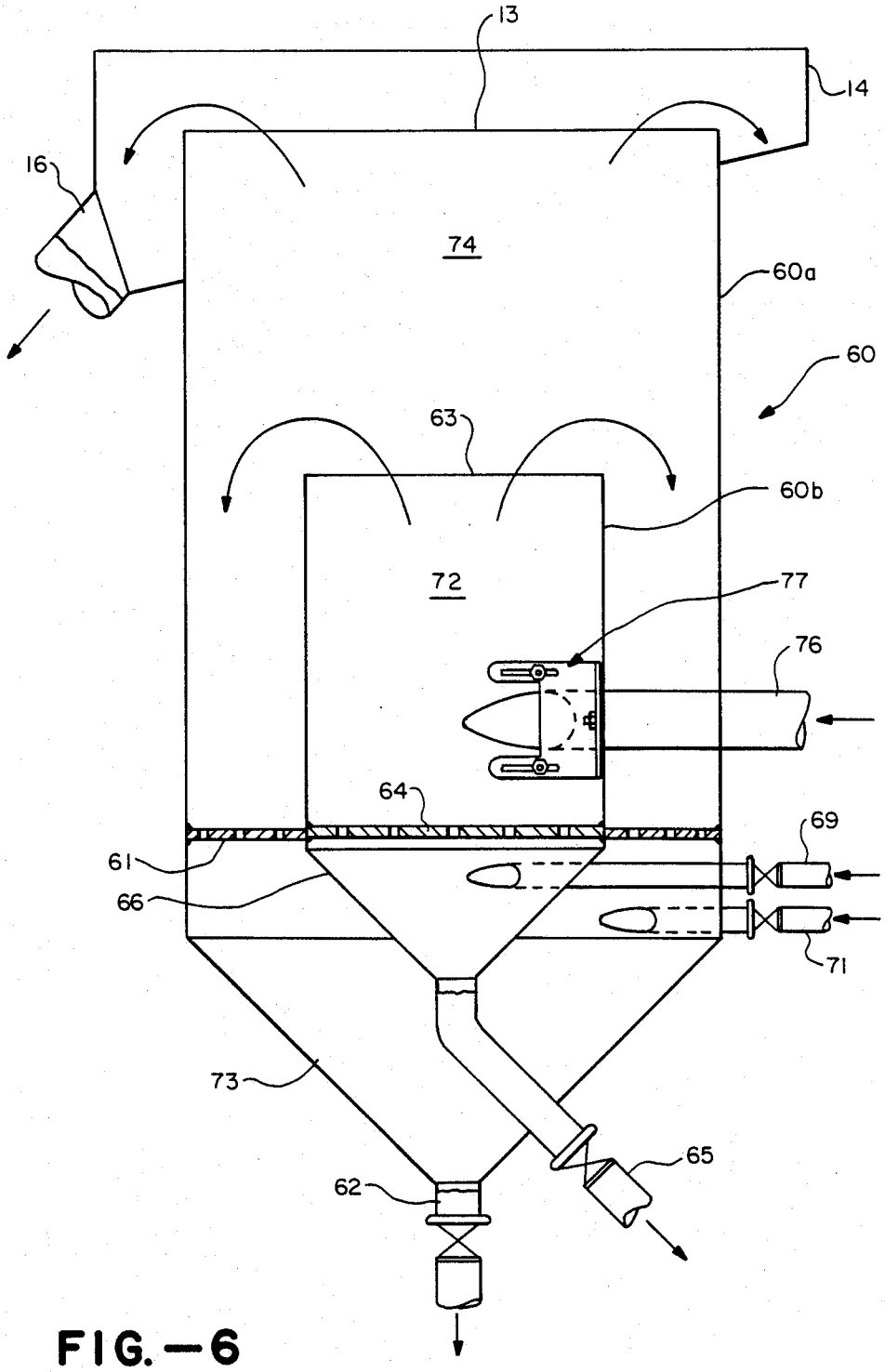
FIG. 6 is a side elevation in section schematically showing another embodiment.

As explained above, with the embodiment of FIG. 5 flow occurs from the tank part 60*a* into the tank part 60*b*. The embodiment of FIG. 6 is similar in construction to FIG. 5, except that the feed pipe 76 introduces the feed slurry tangentially into the tank part 60*b* under the control of slide valve 77. The barriers 61 and 64 function as velocity plates with formation and maintenance of eddy currents. Velocity water is introduced through pipes 69 and 71. When operated as just described, the chamber 72 is the primary prccessing chamber, and 74 is the secondary processing chamber. Flow occurs from chamber 72 into chamber 74 as indicated by the arrows. The middling fraction is removed through pipe 62, the underflow through pipe 65 and the overflow through pipe 16.

What is claimed is:

1. Apparatus for processing aqueous slurries to produce separate fractions containing solids differing in settling velocities, comprising:

(a) an upright tank structure that is circular in horizontal section, the structure including aligned first and second tank parts, the second tank part having a diameter substantially greater than the first tank part, the upper end of the first tank part being freely open to the interior of the second tank part at a level intermediate the upper and lower portions of the second tank part, the interiors of the first and second tank parts forming first and second processing chambers respectively;

(b) means for introducing aqueous feed slurry tangentially into the first processing chamber whereby material in the first chamber is caused to swirl about the vertical axis of the first processing chamber;

(c) a first barrier plate interposed between upper and lower portions of the first tank part chamber and below said means for tangentially introducing feed slurry, said first barrier having holes therer-through;

(d) a second annular barrier plate having holes therethrough and disposed between the sidewalls of the first and second tank parts at a level below the upper end of the first tank part and interposed between upper and lower portions of the second tank part at a level above said first barrier;

(e) means for introducing water into the spaces below each of the first and second barrier plates to cause water to flow upwardly through the holes of both barrier plates and to form jets of water extending above the holes, the upper end of the second tank part forming an overflow weir for discharge of slurry having solids of relatively low settling velocity;

(f) means for removing a middling slurry fraction from the lower portions of the second tank part; and (g) means for removing an underflow slurry of solids of greater settling velocity from the lower portion of the first tank part;

(h) the upper open end of the first tank part forming means for unobstructed swirling flow from the first tank part into the second tank part, thereby inducing swirling in the second tank part.

2. Apparatus as in claim 1 in which the first barrier is annular in configuration, and in which a substantially conical shaped deflector is positioned within the first chamber with the periphery of its base disposed at the inner periphery of the first barrier.

3. Apparatus as in claim 1 in which the means for introducing water into the space below the second barrier is disposed to introduce the water tangentially whereby swirling movement is imparted to the water below the second barrier.

4. Apparatus as in claim 1 in which the means for introducing water into the space below the first barrier is disposed to introduce the water tangentially whereby swirling movement is imparted to water below the first barrier.

5. A hydraulic separating method for processing aqueous slurries to produce separate fractions containing solids differing in settling velocities, the method making use of apparatus comprising an upright tank structure having first and second tank parts aligned on a common vertical axis and forming first and second processing chambers, both tank parts being circular in horizontal section, the second tank part having a diameter substantailly greater than the first tank part, the first tank part having an unobstructed upper open end within the second tank part, the method comprising:

(a) introducing a feed slurry containing solids differing in settling velocities tangentially into the first processing chamber of the first tank part, thereby causing swirling of slurry in the first processing chamber;

(b) introducing water at a controlled rate into a closed space below a first barrier plate having holes therethrough and disposed between upper and lower portions of the first tank part, whereby water is caused to flow upwardly through the holes in the first barrier plate and to jet from the upper side of the barrier plate into the first processing chamber;

(c) introducing water at a controlled rate into the space below a second barrier plate having holes therethrough and disposed between upper and lower portions of the second tank part, whereby water is caused to flow upwardly through the holes in the second barrier, and;

(d) removing an underflow of separated solids of greater settling velocity from the lower portion of the first tank part, said solids being delivered downwardly from the holes of the first barrier;

(e) removing middling solids of intermediate settling rate from the lower portion of the second tank part, said solids being delivered downwardly from the holes of the second barrier;

(f) removing an overflow of solids of relatively low settling velocity at the upper end of the second tank part, said overflow comprising fine solids caused to progress upwardly into the upper part of the second processing chamber from the upper end of the first processing chamer and also from that portion of the second processing chamber between the walls of the first and the second tank parts; and (g) swirling of slurry in the processing chamber of the first tank part to induce swirling in the second tank part.

6. A hydraulic separating method for processing aqueous slurries to produce separate fractions containing solids differing in settling velocities, the method making use of apparatus comprising an upright tank structure having first and second tank parts aligned on a common vertical axis and forming first and second processing chambers, both tank parts being circular in horizontal section, the second tank part having a diameter substantially greater than the first tank part, the first tank part having an upper open end within the second tank part, said method comprising:

(a) introducing a feed slurry containing solids differing in settling velocities tangentially into the first processing chamber of the first tank part, thereby causing swirling of slurry in the first processing chamber;

(b) introducing water at a controlled rate into the space below a first barrier plate having holes therethrough and disposed between upper and lower portions of the first tank part, whereby water flows upwardly through the holes of the first barrier plate and to jet from the upper side of the barrier plate into the first processing chamber;

(c) introducing water at a controlled rate into the space below a second barrier plate having holes therethrough and disposed between upper and lower portions of the second tank part, whereby water flows upwardly through the holes in the second barrier;

(d) causing flow of water through each hole of the barrier plate to establish and maintain eddy currents within the space of each hole whereby particles of greater settling rate progress through the holes of the first barrier and particles of lower settling rate progresss upwardly from the holes and delivered from the upper portion of the first tank part and into the second tank part;

(e) removing an underflow of separated solids of greater settling velocity from the lower portion of the first tank part;

(f) causing flow of water through each hole of the second barrier and causing such flow to establish and mantain eddy currents within the space of each hole whereby particles of greater settling rate progress through the holes to provide a middling fraction and particles of lower settling rate progress upwardly from the holes;

(g) removing the solids of intermediate settling velocity from the lower portion of the second tank part below the second barrier plate;

(h) removing an overflow of solids of relatively low settling velocity at the upper end of the second tank part, said overflow comprising solids progressing into the upper part of the second processing chamber from the upper end of the first progressing chamber and from that portion of the second processing chamber between the walls of the first and the second tank parts.

7. A method as in claim 6 in which water is caused to flow through each of the barrier holes at a rate such that there is jetting of water extending upwardly from the holes.

8. A method as in claim 6 in which water is introduced into the space below the first barrier tangentaally to cause swirling movement of the water before flowing upwardly through the openings in the first barrier.

9. A method as in claim 6 in which water is introduced into the space below the second barrier tangentially whereby the water below said bsrrier is caused to swirl about the axis of the second tank part before being discharged upwardly through the openings in the second barrier plate.

10. A hydraulic separating method for processing aqueous slurries to produce separate fractions containing solid particles differing in settling velocities, the method making use of apparatus comprising an upright tank structure having first and second tank parts aligned on a common vertical axis, both parts being circular in horizontal section, the second tank part having a diameter substantially greater than the first tank part, the first tank part having an upper open end, the second tank part having an overflow weir at is upper end, the method comprising:

(a) introducing a feed slurry containing solids differing in settling rates tangentially into the first tank part;

(b) introducing water at a controlled rate into the space below a first barrier having holes therethrough and disposed between upper and lower portions of the first tank part, the rate of introduction being such that water is discharged upwardly through each of the holes in the first barrier at a rate such that the solids of greatest settling rate are caused to progress through the holes in the first barrier plate and the solids of lesser settling rate are caused to progress upwardly and to be delivered from the upper end of the first tank part;

(c) introducing water at a controlled rate into the space below a second barrier in the lower portion of the second tank part and having holes therethrough, the rate of introduction of water being such that water is discharged upwardly through each of the holes in the second barrier at a rate such that solids of intermediate settling rate are caused to progress through the openings of the seocnd barrier and into the space below the second barrier, the solids of lower settling rate being caused to progress upwardly and mixed with the material discharged from the upper end of the second tank part as an overflow;

(d) removing an underflow of solids of greatest settling velocity from the space below the first barrier; and (e) removing middling solids of intermediate settling velocity from the space below the second barrier; and (f) removing an overflow of solids of relatively low settling rate from the upper portion of the second tank part.

11. The method as in claim 10 in which each of the holes in the barriers and the rate of flow of water upwardly through the same are so proportioned whereby eddies are formed and maintained in each hole, the upward rate of flow of water through the holes being substantially greater than the settling velocity of the heavier particles, the eddies serving to promote separation of particles of differing settling velocities.

* * * * *